US008813533B2

(12) United States Patent
Krintzline et al.

(10) Patent No.: US 8,813,533 B2
(45) Date of Patent: Aug. 26, 2014

(54) POINT FORMING PROCESSES

(75) Inventors: Donald E. Krintzline, Tiffin, OH (US); Thomas E. Hay, Tiffin, OH (US)

(73) Assignee: National Machinery LLC, Tiffin, OH (US)

( * ) Notice: Subject to any disclaimer, the term of this patent is extended or adjusted under 35 U.S.C. 154(b) by 802 days.

(21) Appl. No.: 12/561,767

(22) Filed: Sep. 17, 2009

(65) Prior Publication Data

US 2011/0061434 A1 Mar. 17, 2011

(51) Int. Cl.
*B21J 5/00* (2006.01)

(52) U.S. Cl.
USPC ..... 72/354.2; 72/356; 72/357; 72/43

(58) Field of Classification Search
USPC ..... 72/352, 353.2, 354.2, 356, 357, 360, 72/41–46, 404, 405.1, 253.1, 711
See application file for complete search history.

(56) References Cited

U.S. PATENT DOCUMENTS 2,813,279 A * 11/1957 Friedman ..... 470/8
3,188,849 A 6/1965 Wisebaker et al.
3,364,564 A * 1/1968 Kurtz et al. ..... 29/522.1
3,821,888 A * 7/1974 Stewart ..... 72/60
4,028,919 A * 6/1977 Austen ..... 72/56
4,037,305 A * 7/1977 Larsson ..... 29/421.1
4,041,744 A * 8/1977 Larsson ..... 72/60
4,898,017 A 2/1990 Hite et al.
5,456,100 A * 10/1995 Loomis ..... 72/344
5,531,085 A * 7/1996 Hayes ..... 72/43
5,893,290 A 4/1999 Chang

* cited by examiner

*Primary Examiner* — Shelley Self
*Assistant Examiner* — Matthew G Katcoff
(74) *Attorney, Agent, or Firm* — Pearne & Gordon LLP

(57) ABSTRACT

A set of tooling for a progressive forming machine comprising die and tool units having internal complementary cavity portions for receiving a workpiece, one of said units being arranged to slide a limited distance along its axis and to be biased by a spring force towards the other unit when the units are mounted in the forming machine, the units each having an end face with a smooth surface finish adapted to press against the smooth surface finish of the end face of the other unit, the end face area of one of the units being relatively small compared to its major cross-sectional area whereby a high contact pressure between the end faces is obtained for a given spring bias force such that extrusion/cooling oil coating a workpiece received in the cavity portions is restrained from leakage from the cavity portions across said end faces during a hydrostatic trapped extrusion of the workpiece in the die and tool units whereby the die and tool units are capable of shaping the workpiece to a degree beyond limits of conventional cold-forming processes.

5 Claims, 8 Drawing Sheets

10
11
12
13
14
15
21
23
24
26
31
33
34
35
43
47
56
61
62
63
64
WS1
WS2
WS3
WS4
WS5

70
13
14
12
11
WS1
WS2
WS3
WS4
WS5
WS6
77
76
80

PULLING POSITION

CLOSING POSITION

PICK-UP POSITION
81
86
80
85
86
85
86
86
83
83
84
78
81
86
80

POINT FORMING PROCESSES

BACKGROUND OF THE INVENTION

The invention relates to metal cold-forming and, in particular, machine arrangements and methods for achieving a high reduction in area of a workpiece.

PRIOR ART

Cold-forming machines are typically used to mass produce shaped parts starting with a cutoff of round metal wire. Blanks or workpieces are sheared from a length of wire after straightening from a coil, positioned in successive stationary dies, and struck by reciprocating tools to change their shape into intermediate and, eventually, finished products. These forming operations can include upsetting where the diameter of the wire blank is increased or extrusion where the diameter is reduced or both upsetting and extrusion. Usually, extrusions are accomplished in a stationary die rather than a reciprocating tool. This technique can be problematic where the workpiece is long, i.e. being several times its diameter in length. In these circumstances, the workpiece can tend to stick in the die. The knockout pin used to eject the workpiece from the die, as a result of the area reduction, is relatively small in cross-section. The greater the length of the workpiece compared to its cross-section, the more acute is the problem of ejecting the workpiece from the die. The knockout pin besides being reduced in diameter must be increased in length in relation to the workpiece length and becomes prone to breakage.

Among the challenges to be met has been the economical, high volume production of pointed parts, especially long pointed parts, where the reduction in area approaches at least 95% and where secondary operations off the cold former are to be avoided.

SUMMARY OF THE INVENTION

The invention involves cold-forming methods and machinery for the economical production of metal parts characterized by a high reduction in area and long length or other substantial change in form while avoiding secondary machining operations. The invention is disclosed in the context of a multi-die progressive former, generally known in the art, and a unique arrangement of dies and tools and related instrumentalities. In preferred embodiments, a long, high carbon steel part is pointed with a reduction in area of about 95% in a net shape or near net shape process. At an intermediate station in the disclosed embodiments, the tooling is arranged to perform a novel closed cavity consequent hydrostatic extrusion process. The tooling and method achieves, in high carbon steels for example, area reductions to levels previously generally considered impractical or unobtainable. Use of the hydrostatic extrusion station can be followed by successive forming stations that together can approach or reach a total of 95% reduction in area. This degree of area reduction effectively results in a pointed workpiece. Alternatively, a workpiece can be pointed following the hydrostatic extrusion stage by pulling the workpiece to neck down the area to be pointed and thereafter further extruding it to a final point. Still another pointing method that can follow the unique hydrostatic extrusion step is a pinch pointing process. In this method, once the workpiece is preliminarily reduced in area by the hydrostatic extrusion, it is pinch formed with a flash that can be sheared off or can be broached off by further disclosed techniques.

DESCRIPTION OF THE PREFERRED EMBODIMENTS

Figure 3:
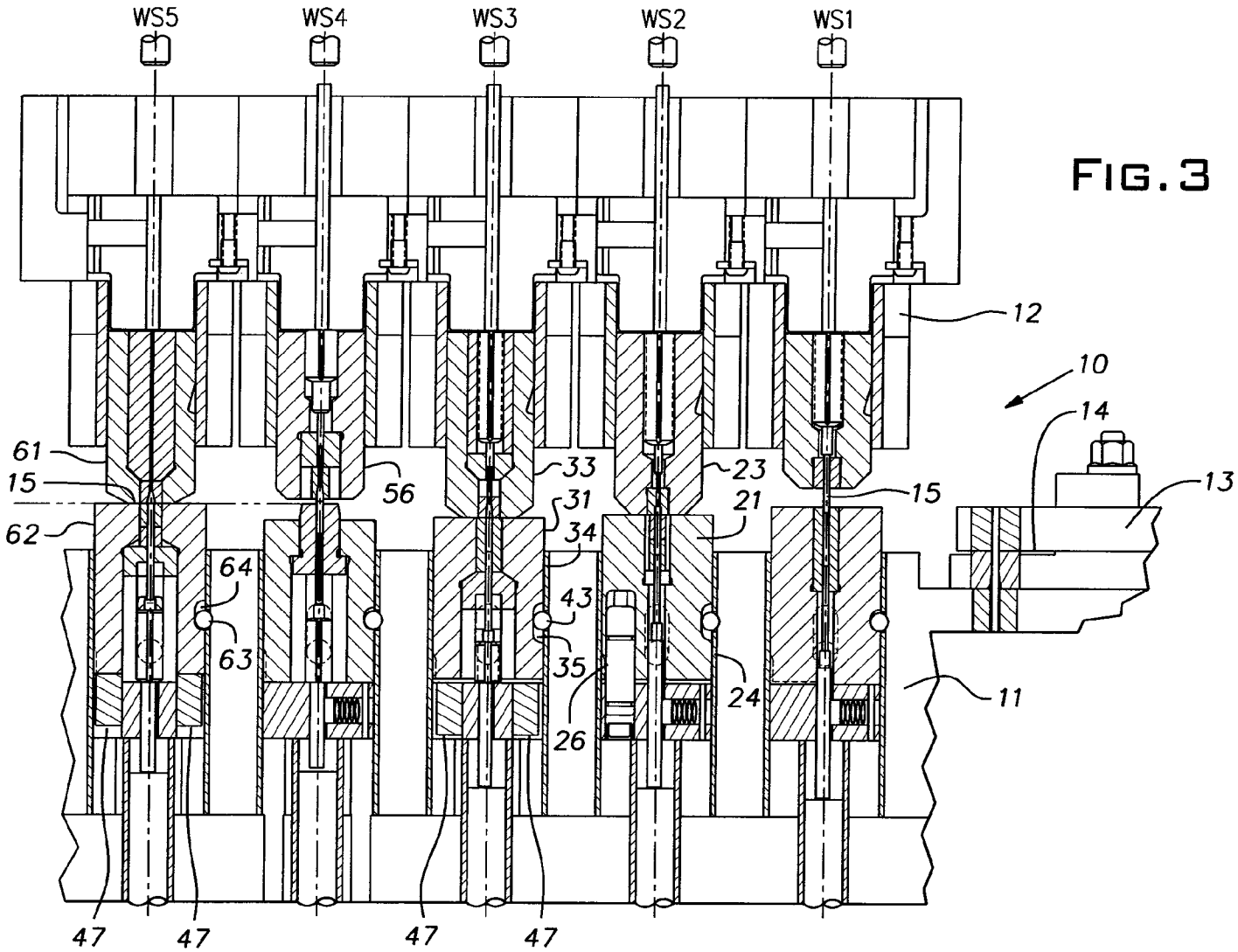
FIG. 3 illustrates additional details of a machine set up in conformity to FIGS. 1 and 2.

Referring to FIG. 3, a cold-forming machine 10 includes a die breast or bolster 11 and a slide or ram 12 guided for reciprocation towards and away from the die breast. U.S. Pat. No. 4,898,017, the disclosure of which is incorporated herein by reference, details the general arrangement and is an example of a machine useful in practicing the present invention. The illustrated machine 10 has five forming stations WS1-WS5 downstream of a cutoff station 13. It is conventional to arrange the cutoff station 13 and successive workstations WS1-WS5 in a common horizontal plane each with an equal spacing from adjacent ones of these stations. This permits a generally conventional mechanical transfer device to move a workpiece 15 progressively from one station to the next in a known manner.

Figure 1:
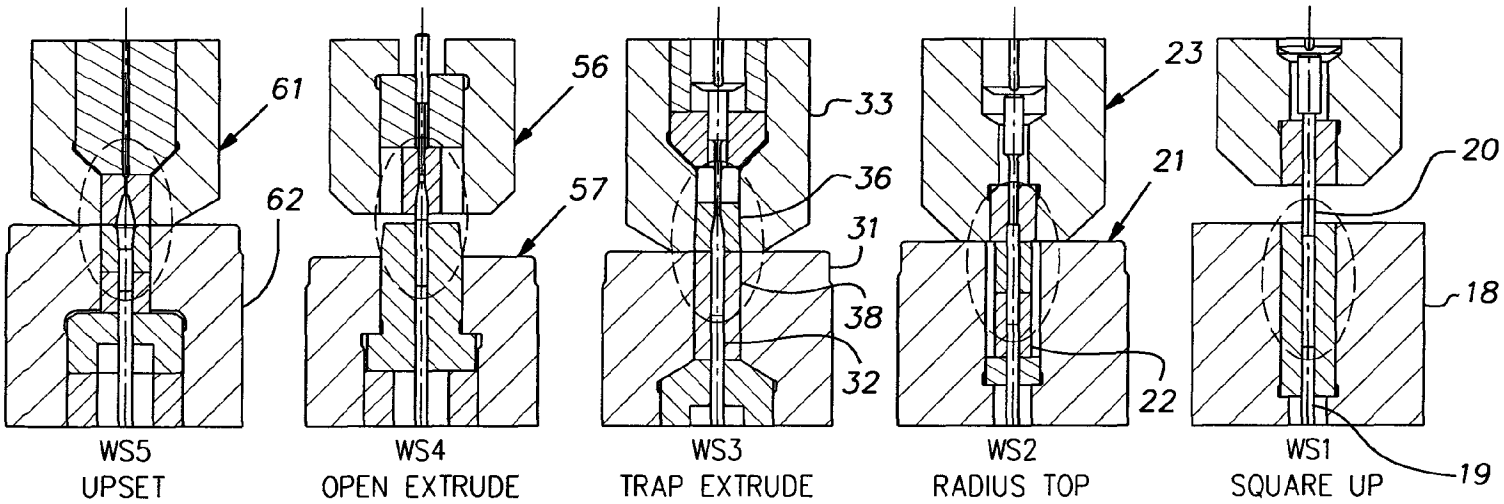
FIG. 1 depicts a series of workstations in a progressive multi-die forming machine in accordance with a first embodiment of the invention.
Figure 2:
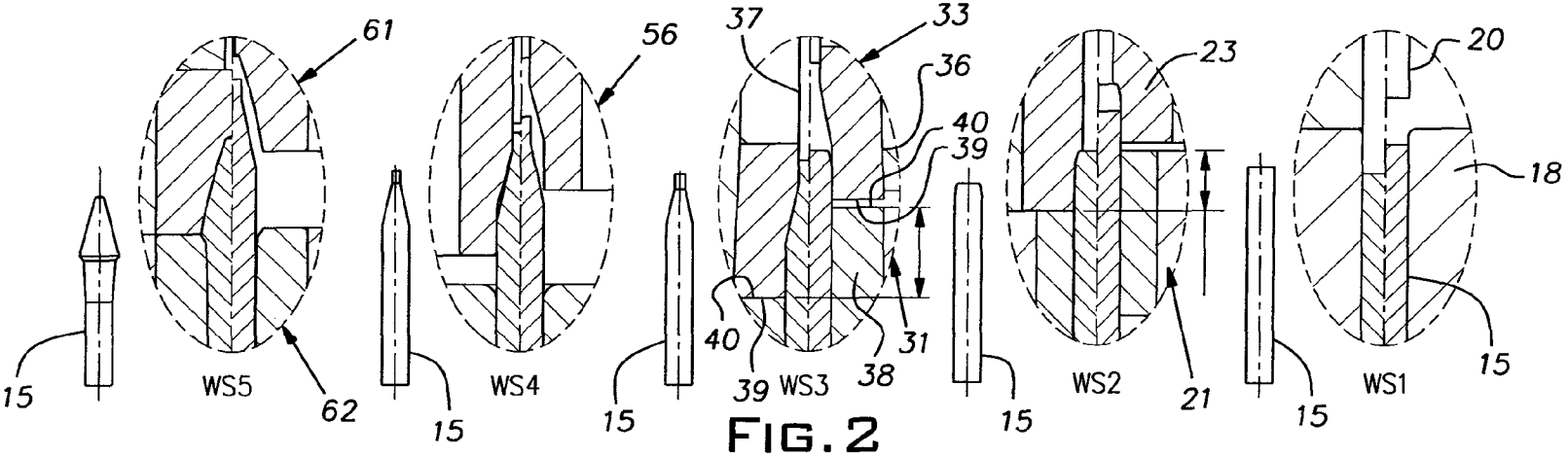
FIG. 2 illustrates tooling areas of the workstations of FIG. 1 on an enlarged scale; the right side of the images are before the end of the workstroke and the left side are at the end of the workstroke.

FIG. 3 illustrates certain details of the machine while enlarged details of the forming tools are illustrated in FIGS. 1 and 2. The workstations of FIG. 2 are superposed with the same workstations in FIG. 1 but are much enlarged. The details of FIG. 2 are split views with the left side showing the parts at the finished position of the tool. The right side of the details in FIG. 2 shows the workpiece or blank received in the die prior to the actual forming operation. The slide 12 is reciprocated in a horizontal plane by a suitable motor and drive system well known in the art.

Ahead of the cutoff station 13 is an auxiliary wire drawer, through which a straightened wire from a coil is fed and drawn to a precise diameter for feeding into the forming machine 10. A phosphate and bonderlube coating is drawn into the outside surface of the wire during the drawing process. At a plane indicated at 14, the cutoff station 13 shears a precise length and, therefore, volume of drawn wire for forming a part or workpiece 15. The sheared end surfaces of the workpiece 15 will be irregular and without the coating due to the shearing operation. Before the slide 12 completes a forming blow, each workpiece 15 has been transferred to the next succeeding workstation. Forward motion of the slide causes a tool at a workstation to insert the workpiece into a die.

In the first workstation WS1, the workpiece 15 is inserted into a die 18 and pressed on both ends by a die kickout pin 19 and tool pin 20. The terms die and tool as used herein will often mean an assembly of a case and an insert in the case. The die and tool cases and inserts are typically cylindrical. Die and tool cavities and kickout pins are, likewise, typically cylindrical or, at least, round in cross-section. The ends of the die and tool pins 19, 20 that contact the workpiece 15 may be flat but preferably have a 3° point to displace material from the center of the workpiece ends to remove the surface variations developed at the sheared faces.

At the second workstation WS2, the forming blow forms a radius on the circumference of the end of the workpiece 15 which end, ultimately, will be greatly reduced in area. This radius squeezes the raw uncoated end of the blank or workpiece 15 so that a round and coated surface will be provided for first contact with an extrusion tool in the subsequent workstation WS3. A small corner radius is formed on the same workpiece end to remove any sharp edges or flash burrs. The operation at this second workstation WS2 is a form of trapped extrusion where the workpiece 15 is totally enclosed in the die 21 before the workpiece is deformed in the work stroke.

In the disclosed embodiments of the invention, the point end of the workpiece 15 is formed in the tool; this technique of "reverse forming" is typically not done in cold-forming processes. Pointing the workpiece 15 while it is partially in the tool and partially in the die requires precise alignment and control between the tool and die. Any significant misalignment would result in non-uniformity of the workpiece, with scraping or metal shaving as it enters a misaligned tool.

The reverse forming process begins with insertion of the workpiece 15 into the die 21, stopping on a kickout pin 22 that is held stationary during the forming workstroke. As the heading slide 12 advances, a tool 23 contacts the die 21 to create a closed cavity. The die 21 is arranged to slide in a die holder 24. In one example, a cluster of five nitrogen gas springs 26 (one of which is shown in FIG. 3 at WS2) are provided to develop a total of 560 lbs. initial spring force. The springs 26 bias the die 21 towards the heading slide 12 while enabling the die to be pushed back with the advancing tool 23 as the workpiece is forced into the tool cavity to produce the required shape. The volume of the workpiece 15 in relation to the die 21 is such that the die is slightly underfilled. Overfilling the die 21 can result in metal flashing between the tool 23 and die where the die spring force is exceeded. It will be understood that the die kickout pins and tool pins at the various workstations are operated by cams in a known manner to assure that the workpiece is ejected from the respective die or tool after the workstroke is completed.

At the third workstation WS3, a reverse forming process, again, begins with a tool 33 inserting the workpiece 15 into a die 31, the workpiece stopping on a kickout pin 32 that is held stationary during the forming workstroke. As the heading slide 12 further advances, the tool 33 contacts the die 31 to create a closed cavity for forming the part. The die 31 slides in a holder 34, being spring biased towards the heading slide 12 and pushed back with the advance of the tool 33 as the material is forced into the tool cavity to trap extrude the required shape defined by the tool. A tangential slot 35 on the die, working with a pin 43 serves to limit axial motion of the die 31 on the die breast to the short distance required for the trap extrusion at this station. By way of example, C1055 steel has been successfully extruded to an 80% reduction in area in this single workstation WS3. Normally, reverse forming by extruding into a tool has previously been limited to approximately 55% reduction in area. Extrusions greater than 55% reduction in area typically result in a workpiece beginning to upset into flash between the tool and die.

The disclosed reverse forming process allows parts with long shank lengths (e.g. lengths of about 3 or more diameters) and smaller point diameters to be successfully formed. The majority of the blank or workpiece 15 remains inside the die 31 with only a short length of the workpiece inside the tool 33. This allows ejection of the workpiece 15 from the die 31 to be proportionately robust, with a full workpiece diameter kickout pin 32. A small diameter tool kickout pin 37 in the tool 33 requires very little force and short kickout distance to eject the workpiece from the tool. The longer length of the workpiece 15 that is inside the die 31 will tend to make the workpiece stay in the die and, therefore, avoid the need for high kickout forces from the tool pin 37. By comparison, conventional trap extrusion forming inside the die would require a proportionately small diameter kickout pin equal to the extruded reduced diameter, with a kickout stroke longer than the overall part length. Such kickout pins are subject to high breakage rates due to length to diameter ratio, and the larger workpiece diameter being kicked out by a small diameter kickout pin.

The process performed at the third workstation WS3, in accordance with the invention, involves an adaptation of hydrostatic extrusion. To accomplish this "consequent hydrostatic extrusion" process, the interface between the die 31 and tool 33 is maintained at a contact pressure adequate to contain the hydrostatic medium which in this case, is liquid cold-forming extrusion/cooling oil. This can be achieved by arranging a tool insert 36 to protrude 0.05 mm to concentrate the closing force on the small diameter face of the insert against the opposing face of a die insert 38. The diameter of the tool and die insert end faces are substantially less than the diameters of the end profiles of the tool and die cases. The workpiece 15 is coated by flooding with the extrusion oil from a dispenser nozzle 41 (FIG. 4) as it enters the die 31. Prior to reception of the workpiece 15 into the die, the kickout pin 32 is frictionally held with its end flush with the face of the die insert 38 so as to exclude any significant volume of oil between the workpiece 15 and end of the kickout pin when it enters the die. The kickout pin 32 is closely fitted to the bore of the die 31 so as to restrict fluid loss around the pin in the forming blow.

It has been found that the tail portion of the workpiece 15 also swells up tight to the die bore to restrict oil loss. When the oil seal is properly maintained, the workpieces 15 extrudes to the required shape without swelling up to the tool and die insert diameters, except for the tail portion of the workpiece near the kickout pin 32. When workpieces are hydrostatically extruding properly as a consequence of the extrusion/cooling oil being confined in the cavity mutually formed in the die insert 38 and tool insert 36, the end of the workpiece remains slightly rounded from underfill, without flashing around the die kickout pin 32. Additionally, the part of the workpiece 15 received in the tool 33 remains about 0.04 mm smaller than the tool and die diameter due to the enclosed hydrostatic oil pressure (with the workpiece having its major diameter nominally about 3.12 mm along its major length). The oil cushion trapped around the workpiece 15 keeps the majority of its body from contacting the cavity surfaces of the tool and die inserts 36, 38, thereby reducing the friction between these forming inserts and the workpiece. It has been found that the workpieces will not extrude properly if the oil application is insufficient or if the tool or die faces, indicated at 39 and 40, are marred so as to prevent a tight oil seal at their interface. These imperfect conditions result in the blank not extruding, but swelling up tight against the tool and die insert surfaces, and flashing around the die kickout pin 32. The added forming pressure may also cause failure of the die kickout pin 32.

The extrusion lengths of the workpieces 15 at the third workstation WS3 are held consistent by stopping the extrusion against the tool knockout pin 37. The end shape of the parts extruded with the disclosed process are unique with a uniform dome shaped end surface. Traditional high reduction trap extrusions have an irregular hollow or cupped end surface.

Figure 4:
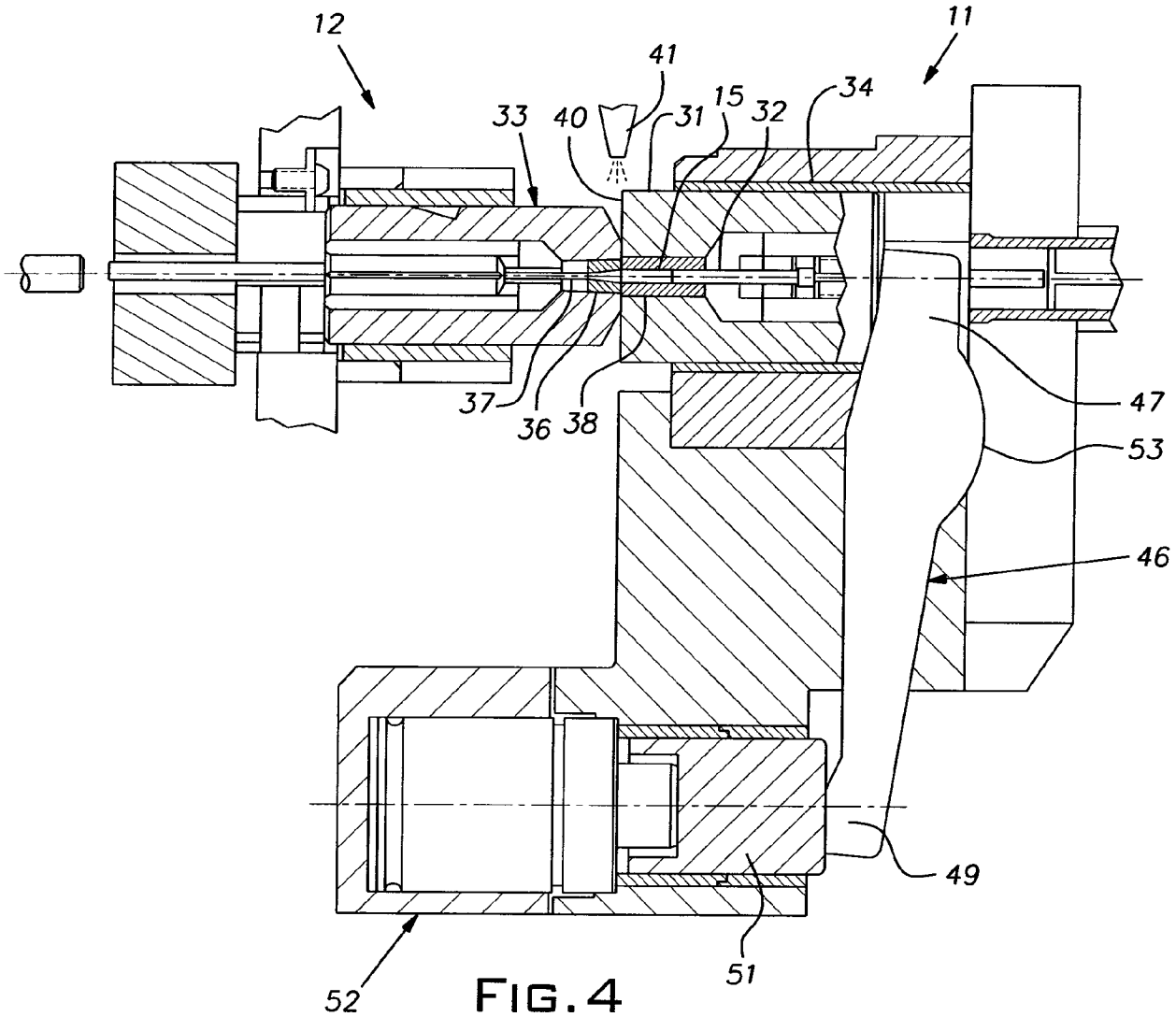
FIG. 4 is a fragmentary vertical section through the third workstation of the machine illustrated in FIG. 3.

FIG. 4 is a somewhat schematic view of the third workstation WS3 taken in a vertical plane through the center of the die holder. A pivotal lever 46 has an upper forked end 47 that presses against the rear of the die 31. A lower end 49 of the lever 46 is engaged by an operating rod 51 connected to a piston of a nitrogen gas spring 52. The gas spring 52 is located below its respective workstation WS3 in a machine area permitting a relatively large spring to exist and enabling its high pressure to be multiplied by the long length of the lower end 49 of the lever 46 compared to the length of the upper end 47 measured from a fulcrum 53. By way of example, the spring 52 and lever 46 can develop 3,200 lbs. of force on the sliding die 31. By comparison, the forming load for the illustrated extrusion is calculated at about 3,000 lbs. Thus, the sliding die spring force is at least equal to the forming load at this workstation WS3. The high pressure lever 46 is capable of developing forces many times greater than the multiple nitrogen springs at the second workstation WS2, the latter of which being limited in potential force by the restrictions of the diameter of the die case.

At the subsequent workstation WS4, a second extrusion is performed to further reduce the end diameter formed in the preceding die 31. At this fourth station WS4, a 35% reduction in area open extrusion of the workpiece 15 into a tool 56 is accomplished. Generally, an open extrusion involves a lighter forming load whereby the body of the workpiece 15 may be unsupported in the open space between a tool 56 and an opposing die 57 without upsetting.

The workpiece 15 is transferred to the fifth workstation WS5 for finish forming. A tool 61 forms an upset head on the workpiece 15 while further reducing the point end diameter. The point end area at this station is reduced by approximately 45%. The 45% reduction is the normal maximum for point forming while upsetting. The die 62 is of the sliding type biased forwardly by a high pressure lever 46 like that shown in FIG. 4. The limited die slide action is accommodated at the fifth station of FIG. 3 by a pin 63 and slot 64. The disclosed process has successfully formed parts to a full form finish shape with smooth end surfaces.

Referring now to FIGS. 5-8, inclusive, a second process for reducing the area of or pointing a workpiece is disclosed. In this process, a multi-die cold former 70 has six workstations. The machine 70 has the general arrangement of the earlier described machine 10 and the same is true of machines associated with other processes and equipment disclosed below in connection with FIGS. 9-12.

Figure 6:
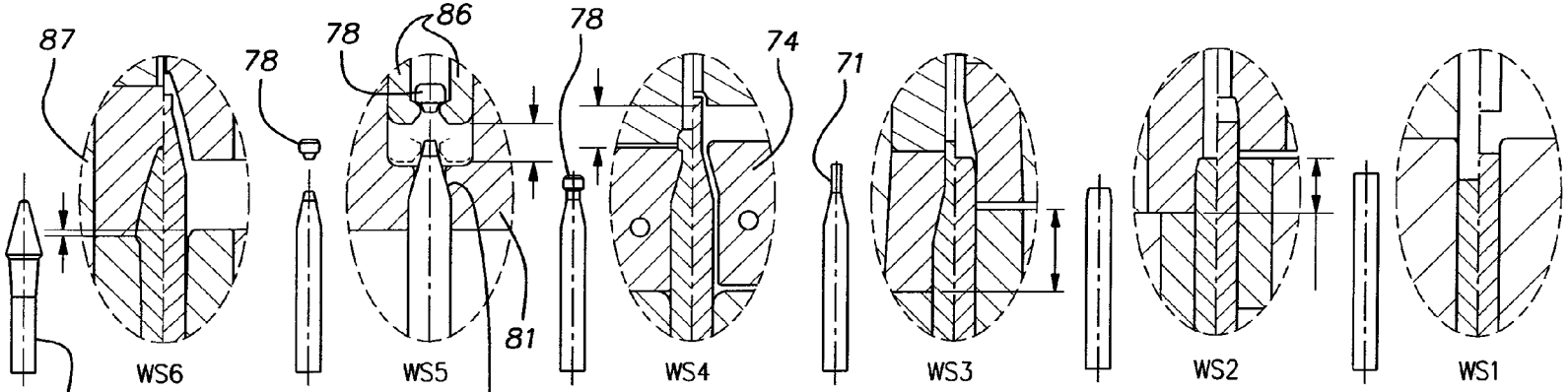
FIG. 6 illustrates tooling areas of the workstations of FIG. 5 on an enlarged sale; the right side of the images are before the end of the workstroke and the left side are at the end of the workstroke.
Figure 5:
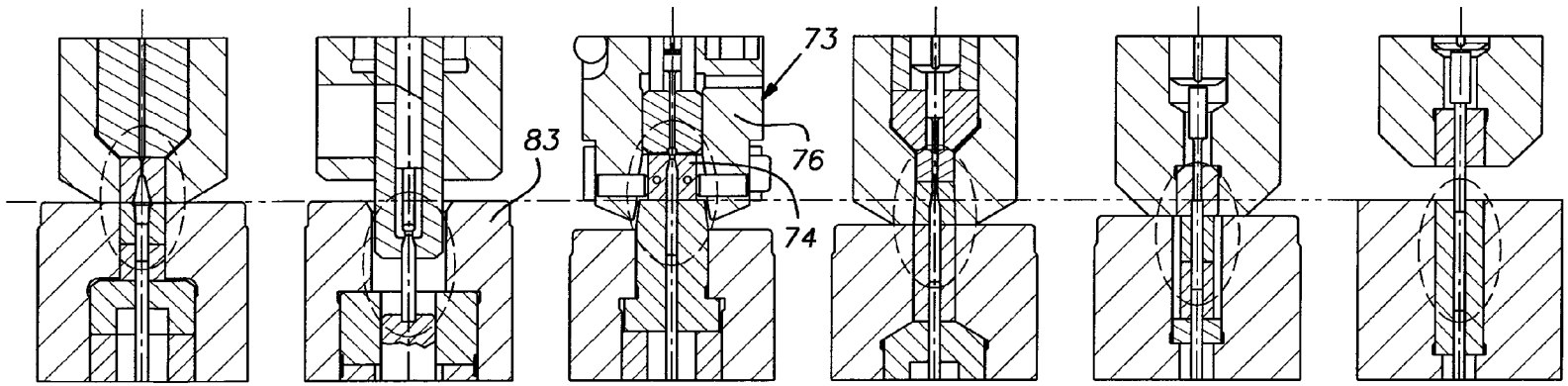
FIG. 5 depicts a series of workstations in a progressive multi-die forming machine in accordance with a second embodiment of the invention.

The first three workstations are arranged essentially the same as those described above in connection with the cold-forming machine 10 shown in previous FIGS. 1-4. Where appropriate, the same numerals have been used to designate the same or like parts in the respective machines 10, 70. The process involves a reduction in area extrusion, a subsequent reduction by pulling, followed by a combination upset and extrusion step to finish the part. Detail of the forming tools used in the presently described "pulling" process is shown in FIGS. 5 and 6. In FIG. 6, the enlarged details are split views with the right side showing a workpiece at a respective die prior to the forming operation and the left side showing the parts at the fully advanced position of the respective tools. At the third workstation WS3, the trap extrusion forms a reduced stem 71 on the end of a workpiece to be pointed.

Figure 7:
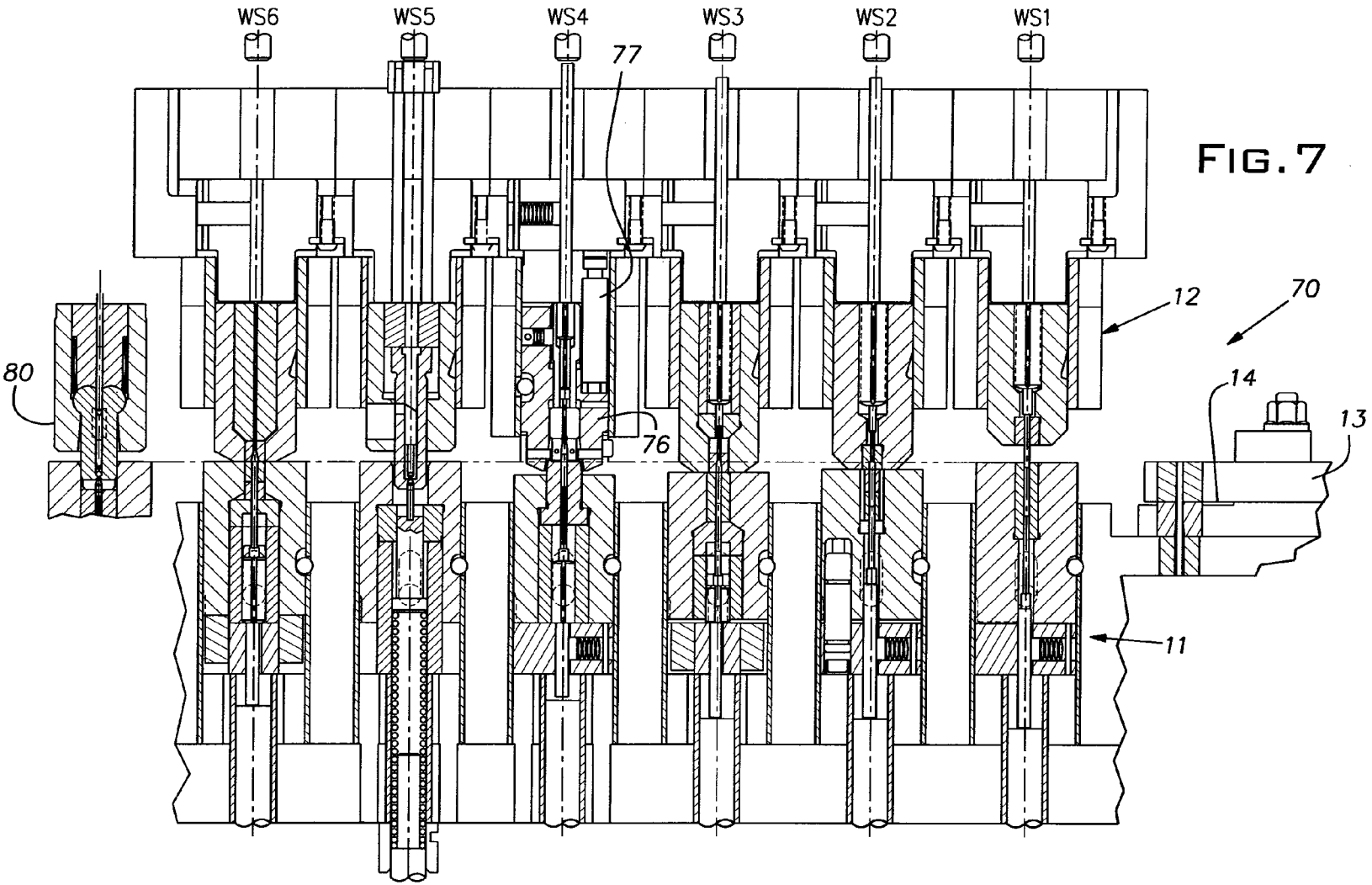
FIG. 7 illustrates additional details of a machine set up in conformity to FIGS. 5 and 6.
Figures 8A, 8B, 8C:
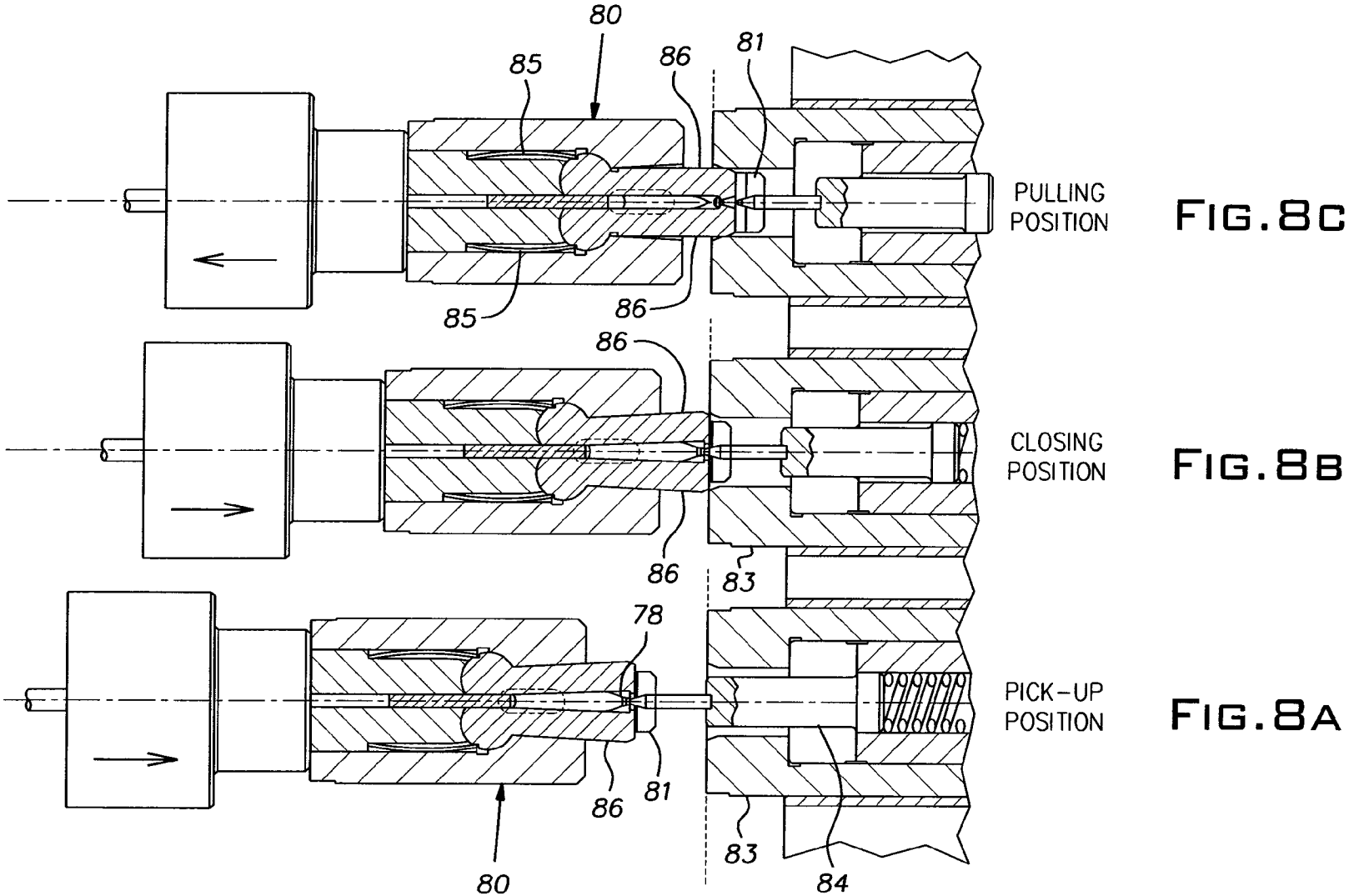
FIGS. 8A, 8B, and 8C illustrate operations of the tooling at the fifth workstation of the machine depicted in FIG. 7.

At the fourth workstation WS4, the end of the stem 71 is upset into a bulb-shape 78 for gripping in the subsequent pulling station WS5. The forming operation at the fourth station WS4 uses a sliding tool 73 with tool segments or inserts 74 for forming a small bulb-shaped upset on the reduced stem 71. The tool segments 74 can be four in number and are disposed at the front of a tool case 76. The segments 74 are allowed to move within the tool case 76 to close together during the upsetting motion and to open to allow clearance for the upset bulb 78 to be ejected from the tool cavity mutually formed by the segments. A plurality of nitrogen gas springs 77 (one such spring is shown in FIG. 7 at the fourth workstation WS4) bias the tool case towards the die. The combined spring pressure is adequate for holding the segments 74 closed against one another for a relatively small upsetting load. A circumferential indent formed by the segments 74, may be added at the base of the bulb 78 to facilitate a uniform break off of the bulb or slug.

At the fifth workstation WS5, the upset bulb 78 is pulled apart from the remainder of the workpiece to thereby reduce or neck down the area of the stem beneath the bulb 78. At this workstation WS5, a front pusher sleeve 81 (FIGS. 8A-C) of a tool assembly 80 slips over the upset bulb 78 formed at the preceding station and pushes on a tapered shoulder of the workpiece behind the bulb so as to insert the workpiece into a die 83. A spring loaded plunger 84 in the die 83 receives the opposite end of the workpiece and retracts, holds and extends during operations at this station. Two opposed pivoting gripper inserts 86, extending radially through slots in the pusher sleeve 81 close on the reduced neck of the workpiece 72 as the gripper inserts enter the die case 83, shown by the transition between FIGS. 8B and 8C. The grippers 86 are biased open apart from one another by leaf springs 85. A tool kickout mechanism of conventional construction is timed to hold the pusher sleeve 81 stationary while the heading slide 12 and the tool assembly 80 with its grippers 86 pull away from the die 83. The tool kickout travel causes the pusher sleeve 81 to lag and allow the upset bulb 78 to be pulled by the grippers 86 away from the tapered shoulder 82 ultimately breaking off the bulb or slug.

At the sixth workstation WS6, a tool 87 forms an upset head on the workpiece 72 while further reducing the point end diameter.

Figure 10:
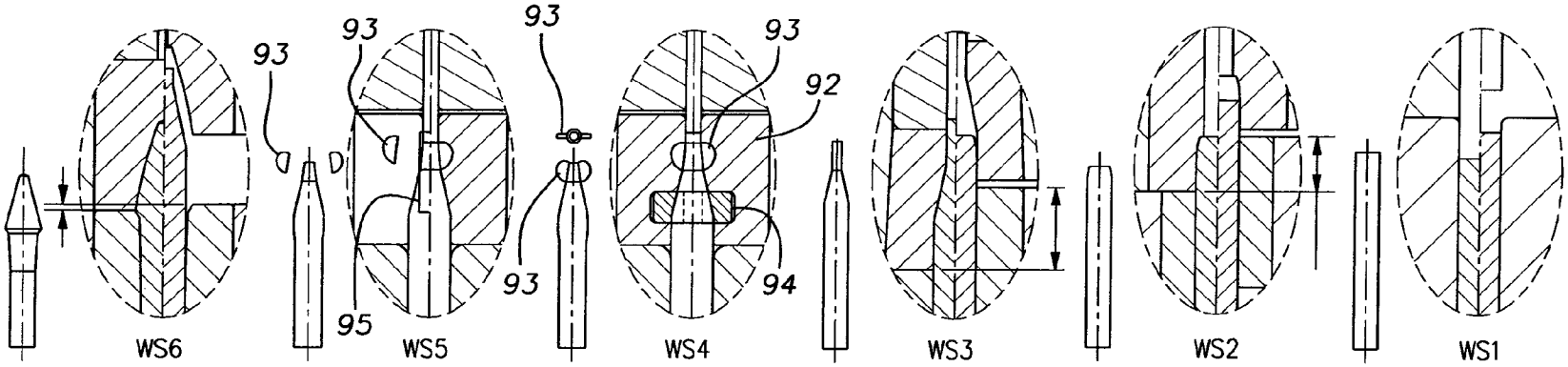
FIG. 10 illustrates tooling areas of the workstations of FIG. 9 on an enlarged scale.
Figure 9:
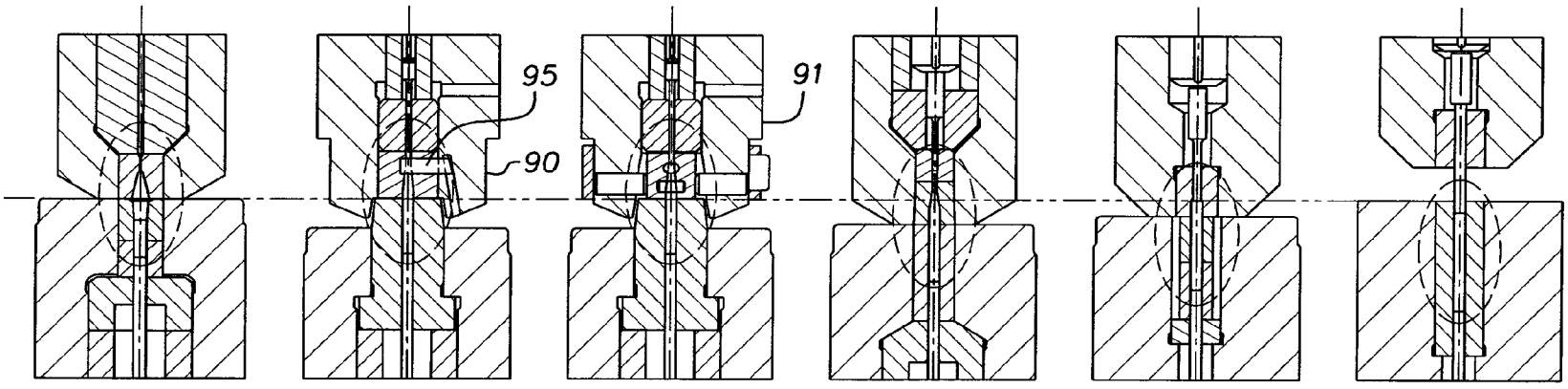
FIG. 9 illustrates a series of workstations in progressive multi-die forming machine in accordance with a third embodiment of the invention.

Referring now to FIGS. 9 and 10, there is shown a point forming process involving a combination of extrusion and pinch trim. The process of FIGS. 9 and 10 utilizes substantially the same initial steps and tooling as the first three workstations in the preceding two disclosed forming processes. These steps are followed by a pinch pointing technique involving a formed sideways upset with flash and then followed by a sideways trimming operation to remove the flash. More specifically, at a fourth workstation WS4 a tool case 91 carries segments or inserts 92 that upset a point shape with flash 93. The segments 92 are allowed to move within the tool case 91 to close together during the upsetting and to open to allow clearance for the part to be ejected. A small insert 94 inside the split inserts 92 is a stop to hold the shoulder of the part at the forming position within the inserts. The small insert 94 has a central slot to allow the flash 93 to pass and the part to be ejected.

The plane of the drawings at the fifth workstation WS5 in FIGS. 9 and 10 is rotated 90 degrees from that of the fourth workstation WS4. A slide 95 in a tool case 90 is driven sideways as the tool case approaches the opposing die causing the flash 93 to be sheared from the workpiece. At the sixth station WS6 the part is upset and further pointed.

Figure 12:
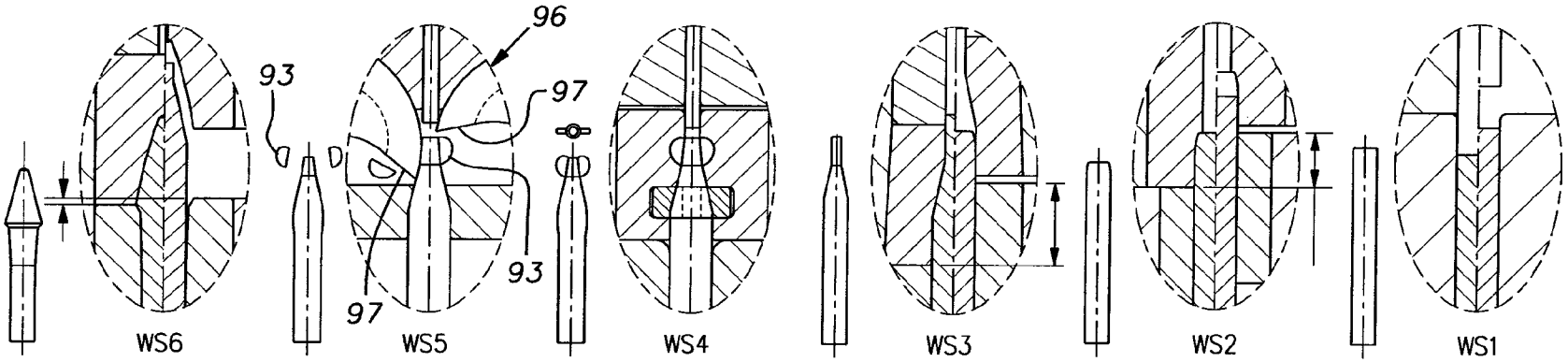
FIG. 12 illustrates tooling areas of the workstation of FIG. 11 on an enlarged scale.
Figure 11:
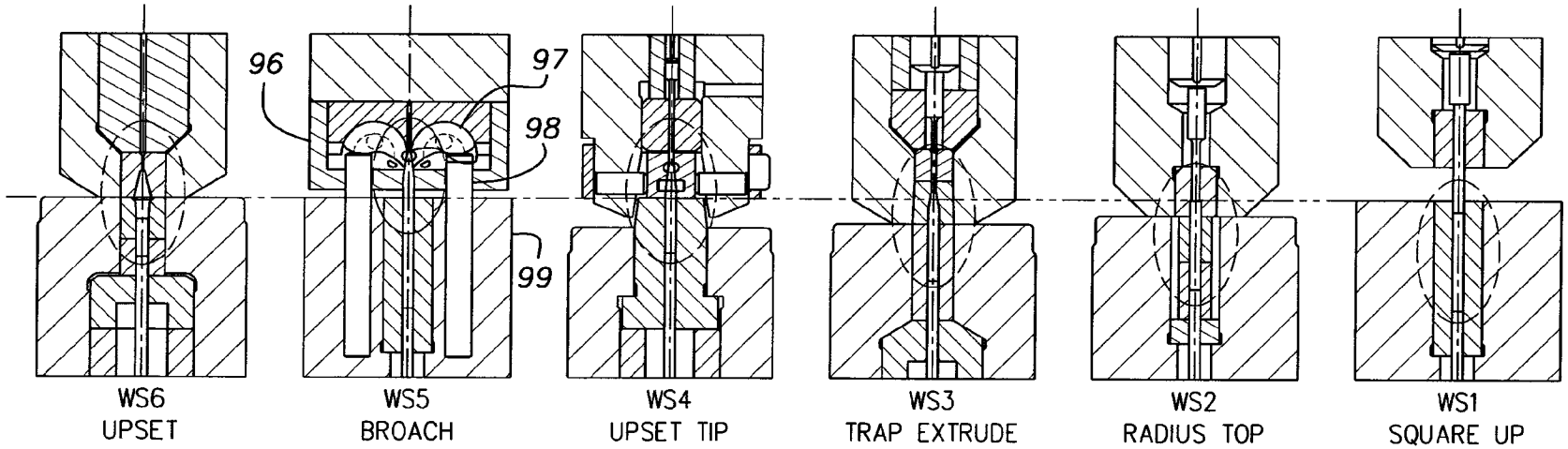
FIG. 11 illustrates a series of workstations in a progressive multi-die forming machine in accordance with a fourth embodiment of the invention.

The process depicted in FIGS. 11 and 12 is the same as that described in reference to FIGS. 9 and 10 except for the operation conducted in the fifth workstation WS5. Here, the flash 93 upset produced at the fourth workstation WS4 is removed with a broaching tool 96. Broaching or cutting blades 97 are pivotally mounted within the tool 96. Pusher pins 98 mounted in a die 99 engage and rotate the broaching blades 97 to remove the flash 93 produced in the earlier workstation WS4. At the last workstation WS6 the part is upset and further pointed as previously described.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A method of cold-forming workpieces in a multi-die machine comprising the steps of receiving a workpiece at a workstation, providing a set of tooling including die and tool units respectively supported on a die breast and slide, one of the tooling units being arranged to slide a limited distance on its supporting structure, a spring arranged to bias said one tooling unit towards the other tooling unit, the end faces of the die and tool units being arranged with mutual contact areas that are smooth, dispensing extrusion/cooling oil at the workstation in a manner that coats the exterior of the workpiece, the die and tool units being arranged such that their end faces engage before the slide reaches its forwardmost position while the spring maintains a contact force at their end faces, the relationship of the spring force and contact area being such that the end faces seal against escape of oil from the cavity formed by the die and tool units whereby forming pressure is imparted to the workpiece to produce a consequent hydrostatic pressure in the oil in the cavity that facilitates a high reduction in cross-section of the workpiece exceeding 55%.

2. A method of cold-forming as set forth in claim 1, wherein the area of reduction is concentric with an axis of the workpiece.

3. A method of cold-forming with high reduction in area comprising operating a cold-forming machine with a die breast and a slide that reciprocates towards and away from the die breast, mounting a die on the die breast for limited sliding movement along a direction parallel to the slide motion, biasing the die with a spring towards the slide whereby the end faces of the die and cooperating tool are held together for a distance in the final portion of the advance stroke of the slide for a trap extrusion, inserting a cylindrical workpiece in the die, during insertion of the workpiece, flooding the workpiece with extrusion/cooling oil and maintaining a kickout pin closely fitted to a bore at the entrance to the die to exclude appreciable volume of oil apart from that coating the workpiece, the force of the spring being sufficiently high in relation to the contact area of the die and tool end faces and the finish of these end faces to be effective to seal against significant leakage of oil across these faces such that a trapped extrusion of the workpiece into the tool is augmented by a hydrostatic extrusion effect of the oil to achieve a high reduction of area of the workpiece exceeding 55% in the tool.

4. A method as set forth in claim 3, in which the workpiece is transferred to a subsequent workstation where it is open-extruded to effect a further reduction in area.

5. A method as set forth in claim 4, wherein the workpiece is transferred to a successive workstation where it is upset and further pointed.

* * * * *